US011499250B2

(12) United States Patent
Smith et al.

(10) Patent No.: US 11,499,250 B2
(45) **Date of Patent: *Nov. 15, 2022**

(54) BICOMPONENT SPANDEX

(71) Applicant: The LYCRA Company LLC, Wilmington, DE (US)

(72) Inventors: Steven W. Smith, Waynesboro, VA (US); Hong Liu, Waynesboro, VA (US); David A Wilson, Waynesboro, VA (US); James B Elmore, Crimora, VA (US)

(73) Assignee: THE LYCRA COMPANY LLC, Wilmington, DE (US)

( * ) Notice: Subject to any disclaimer, the term of this patent is extended or adjusted under 35 U.S.C. 154(b) by 475 days.

This patent is subject to a terminal disclaimer.

(21) Appl. No.: 15/834,223

(22) Filed: Dec. 7, 2017

(65) Prior Publication Data

US 2018/0195208 A1 Jul. 12, 2018

Related U.S. Application Data

(62) Division of application No. 13/124,433, filed as application No. PCT/US2009/060376 on Oct. 12, 2009, now Pat. No. 9,869,040.

(60) Provisional application No. 61/106,288, filed on Oct. 17, 2008.

(51) Int. Cl.
*D01F 8/16* (2006.01)

(52) U.S. Cl.
CPC ..... *D01F 8/16* (2013.01); *Y10T 428/2929* (2015.01); *Y10T 428/2931* (2015.01); *Y10T 442/3065* (2015.04); *Y10T 442/3089* (2015.04); *Y10T 442/425* (2015.04); *Y10T 442/641* (2015.04)

(58) Field of Classification Search
CPC ..... D01F 6/70; D01B 2401/061; D04B 1/18; D03D 15/08
See application file for complete search history.

(56) References Cited

U.S. PATENT DOCUMENTS

| | | | |
|---|---|---|---|
| 5,162,074 | A | 11/1992 | Hills |
| 5,256,050 | A | 10/1993 | Davies |
| 5,626,960 | A | 5/1997 | Carney |
| 5,849,410 | A | 12/1998 | Nelson et al. |
| 6,248,273 | B1 | 6/2001 | Benin et al. |
| 6,248,445 | B1 | 6/2001 | Yamakawa et al. |
| 6,403,682 | B1 | 6/2002 | Goodrich et al. |
| 6,867,260 | B2 | 3/2005 | Datta et al. |
| 7,238,423 | B2 | 7/2007 | Calhoun et al. |

(Continued)

FOREIGN PATENT DOCUMENTS

| | | |
|---|---|---|
| JP | 4-316610 A | 11/1992 |
| JP | 2869209 B2 | 3/1999 |

(Continued)

OTHER PUBLICATIONS

Final Office Action received for copending U.S. Appl. No. 13/124,433, dated Jun. 3, 2015, 11 Pages.

(Continued)

*Primary Examiner* — Arti Singh-Pandey
(74) *Attorney, Agent, or Firm* — Christina Geerlof; Kathleen A. Tyrrell

(57) ABSTRACT

An elastic multiple component fiber comprising a cross-section, wherein at least a first region of said cross-section comprises a polyurethaneurea composition; and comprising a second region.

39 Claims, 5 Drawing Sheets

(56) References Cited

U.S. PATENT DOCUMENTS

| | | | |
|---|---|---|---|
| 7,838,617 | B2 | 11/2010 | Houser et al. |
| 9,869,040 | B2 | 1/2018 | Smith et al. |
| 2005/0165200 | A1 | 7/2005 | Selle et al. |
| 2009/0305037 | A1 | 12/2009 | Tsukada et al. |
| 2011/0275265 | A1 | 11/2011 | Smith et al. |
| 2015/0044448 | A1 | 2/2015 | Smith |

FOREIGN PATENT DOCUMENTS

| | | | |
|---|---|---|---|
| JP | 2003-171831 | A | 6/2003 |
| JP | 2005-330617 | A | 12/2005 |
| KR | 1994-0005924 | B1 | 6/1994 |
| WO | 2007/032449 | A1 | 3/2007 |
| WO | 2010/045155 | A2 | 4/2010 |
| WO | 2010/045155 | A3 | 7/2010 |

OTHER PUBLICATIONS

Final Office Action received for copending U.S. Appl. No. 13/124,433, dated Sep. 9, 2016, 07 Pages.

Non-Final Office Action received for copending U.S. Appl. No. 13/124,433, dated Nov. 6, 2014, 08 Pages.

Notice of Allowance received for copending U.S. Appl. No. 13/124,433, dated Sep. 8, 2017, 09 Pages.

Restriction/Election Requirement issued in copending U.S. Appl. No. 13/124,433, filed Jun. 23, 2011, dated Jun. 20, 2014, 08 pages.

International Preliminary Report on Patentability Received for PCT Patent Application No. PCT/US2009/060376, dated Apr. 28, 2011, 6 Pages.

International Search Report and Written Opinion received for PCT Patent Application No. PCT/US2009/060376, dated May 20, 2010, 7 Pages.

Cooke, "Handbook of Fiber Science & Technology", vol. III, High Technology Fibers, Part D, 1996, pp. 247-284.

Couper, "Handbook of Fiber Science & Technology", vol. III, High Technology Fibers, Part A, 1996, pp. 51-85.

Jeffries, "Bicomponent Fibres", 1971, Merro Publishing Co. Ltd.

Ziabicki, "Fundamentals of Fibre Formation", The Science of Fibre Spinning and Drawing, 1976, pp. 196-241.

BICOMPONENT SPANDEX

CROSS-REFERENCE TO RELATED APPLICATION

This application is a divisional of Non-Provisional application Ser. No. 13/124,433 filed Jun. 23, 2011, a 371 of International Application PCT/US2009/060376, filed Oct. 12, 2009, and claims benefit of priority from Provisional Application No. 61/106,288, filed Oct. 17, 2008.

BACKGROUND OF THE INVENTION

Field of the Invention

Included are elastic fibers prepared by a solution-spinning process such as spandex including polyurethaneurea compositions that have a cross-section including at least two separate regions with definable boundaries wherein at least one region defined by the boundaries of the cross-section includes a polyurethaneurea composition.

Description of the Related Art

Historically, highly functional elastomeric multiple component (multicomponent) fibers have been sought through melt processable polymers such as thermoplastic polyurethane (TPU), polyesters, polyolefins, and polyamides. However, these structures lack sufficient recovery power, suffer from low thermal resistance, or give large permanent set when extended beyond certain levels. A preferred and well-known polymer class with superior recovery, thermal resistance, and low set are the polyurethane-urea based systems generically classified as spandex or elastane. However, due to strong intermolecular bonding, fibers from this class must be formed from extruded polymer solutions with a hot inert gas for solvent recovery.

Elastic fibers such as spandex (also known as elastane) are used today in a wide variety of products. Examples include hosiery, swimwear, clothing, hygiene products such as diapers, among many others. The polyurethaneurea compositions that are used to prepare spandex fibers have some limitations that have led to modifications such as including additives or altering the polymer composition to prevent degradation and to enhance dyeability, among many others.

In U.S. Pat. No. 5,626,960 huntite and hydromagnesite additives are included which reduce degradation over time due to exposure to chlorine.

U.S. Patent Application Publication No. 2005/0165200A1 provides a specific polyurethaneurea composition which includes an increased number of amine ends which increases the dyeability of the spandex fiber.

U.S. Pat. No. 6,403,682 provides a polyurethaneurea composition including quaternary amines as additives that increases the dyeability of the spandex fiber.

While each of these spandex compositions provides additional functionality to the fiber, this can be at the expense of favorable properties of the fiber. For example, altering the spandex composition or including additives can reduce the elasticity of the fiber or increase the likelihood that the fiber will break during processing or have some other negative effect.

Therefore, there is a need for new spandex fibers that will maintain the favorable properties of the fiber, such as elasticity, while also providing other benefits that increase the functionality of the fiber, particularly in end use products such as garments, swimwear, and hosiery.

SUMMARY OF THE INVENTION

The present invention relates to products and process for production of multicomponent spandex fibers with enhanced functionality.

In some embodiments are elastic multiple component fibers including a cross-section, wherein at least a first region of the cross-section comprises a polyurethaneurea composition; and comprising a second region. In some embodiments the first region and second region include different compositions.

In some embodiments are elastic multiple component solution-spun fibers including a cross-section, wherein at least a first region of the cross-section comprises a polyurethane or polyurethaneurea composition; and including a second region.

In some embodiments are elastic bicomponent fibers including a sheath-core cross-section, a core region including a polyurethane or polyurethaneurea composition and a sheath region including a polyurethane or polyurethaneurea composition, wherein the core region and the sheath region are compositionally different.

In some embodiments is an article including an elastic multiple component fiber including a cross-section, wherein at least one region of the cross-section includes a polyurethaneurea composition.

In some embodiments are processes for preparing multiple component fibers. One process includes:

(a) providing at least two polymer compositions wherein at least one of the compositions includes a polyurethaneurea solution;

(b) combining the compositions through distribution plates and orifices to form filaments having a cross-section;

(c) extruding the filaments through a common capillary; and (d) removing solvent from the filaments;

wherein the cross-section includes a boundary between the polymer compositions.

Also included are elastic multiple component fibers including a cross-section, wherein at least one region of the cross-section includes a polyurethane or polyurethaneurea composition and at least one region of the fiber is solution-spun.

In another embodiment is an elastic bicomponent fiber including a side-by-side cross-section having a first region and a second region each including a compositionally different polyurethaneurea.

DETAILED DESCRIPTION OF THE INVENTION

Definitions

Figure 1A:
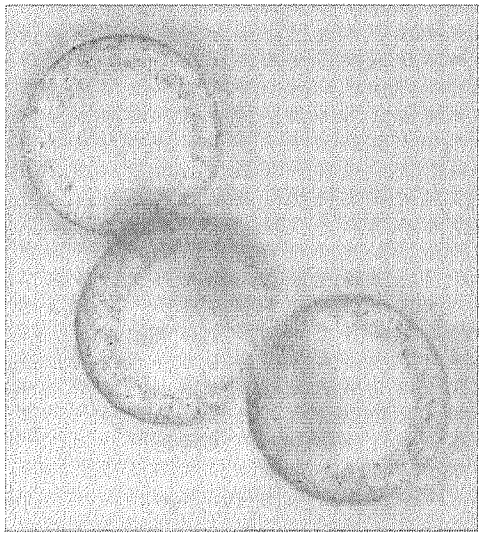
FIGS. 1A, 1B, 1C and 1D show examples of fiber cross-sections that can be achieved in some embodiments.
Figure 1B:
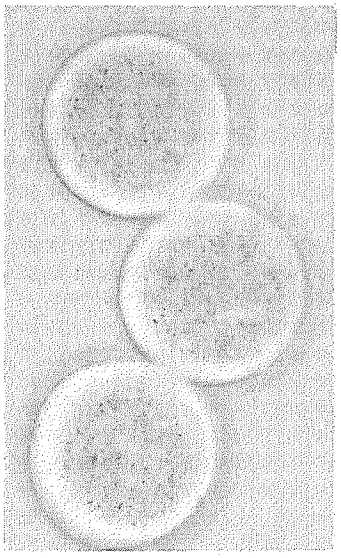
Figure 1C:
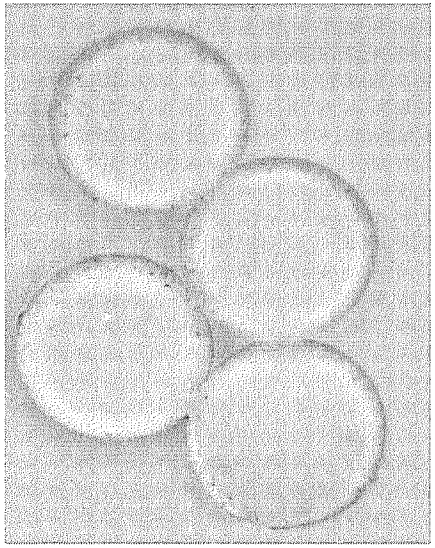
Figure 1D:
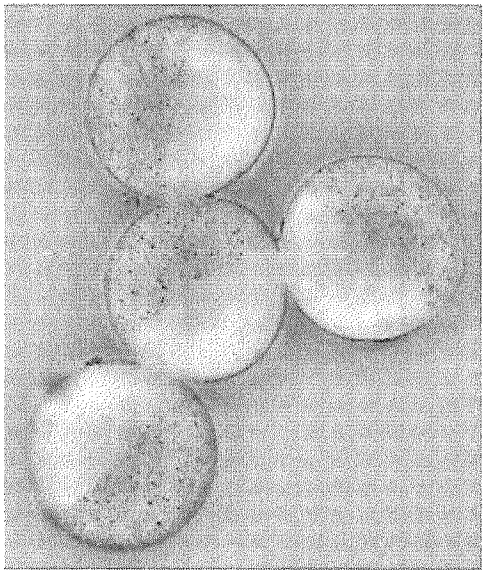

The term "multiple component fiber" as used herein means a fiber having at least two separate and distinct regions of different compositions with a discernable boundary, i.e., two or more regions of different compositions that are continuous along the fiber length. This is in contrast to polyurethane or polyurethaneurea blends wherein more than one composition is combined to form a fiber without distinct and continuous boundaries along the length of the fiber. The terms "multiple component fiber" and "multicomponent fiber" are synonymous and are used interchangeably herein.

The term "compositionally different" is defined as two or more compositions including different polymers, copolymers or blends or two or more compositions having one or more different additives, where the polymer included in the compositions may be the same or different. Two compared compositions are also "compositionally different" where they include different polymers and different additives.

The terms "boundary," "boundaries," and "boundary region" are used to describe the point of contact between different regions of the multicomponent fiber cross-section. This point of contact is "well-defined" where there is minimal or no overlap between the compositions of the two regions. Where overlap does exist between two regions, the boundary region will include a blend of the two regions. This blended region may be a separate homogenously blended section with separate boundaries between the blended boundary region and each of the other two regions. Alternatively, the boundary region may include a gradient of higher concentration of the composition of the first region adjacent to the first region to a higher concentration of the composition of the second region adjacent to the second region.

As used herein, "solvent" refers to an organic solvent such as dimethylacetamide (DMAC), dimethylformamide (DMF) and N-methyl pyrrolidone.

The term "solution-spinning" as used herein includes the preparation of a fiber from a solution which can be either a wet-spun or dry-spun process, both of which are common techniques for fiber production.

In some embodiments of the present invention are multicomponent, or bicomponent fibers including a solution-spun polyurethaneurea composition, which is also referred to as spandex or elastane. The compositions for the different regions of the multi-component fibers include different polyurethaneurea compositions in that the polymer is different, the additives are different, or both the polymer and additives are different. By providing a multiple component fiber, a variety of different benefits can be realized. For example, reduced cost due to use of additives or a more expensive polyurethaneurea composition in only one region of the fiber while maintaining comparable properties. Also, improved fiber properties can be realized by the introduction of new additives that would be incompatible with a conventional monocomponent spandex yarn or through a synergistic effect of combining two compositions.

In order to help insure suitability of the spandex fiber to yarn processing, fabric manufacturing, and consumer satisfaction when contained in a garment, a number of additional properties can be adjusted. Spandex compositions are well-known in the art and may include many variations such as those disclosed in Monroe Couper, Handbook of Fiber Science and Technology: Volume III, High Technology Fibers Part A. Marcel Dekker, INC: 1985, pages 51-85. Some examples of those are listed here.

Spandex fiber may contain a delusterant such as $TiO_2$, or another other particle with at refractive index different from the base fiber polymer, at levels of 0.01-6% by weight. A lower level is also useful when a bright or lustrous look is desired. As the level is increased the surface friction of the yarn may change which can impact friction at surfaces the fiber contacts during processing.

The fiber breaking strength as measured in grams of force to break per unit denier (tenacity in grams/denier) may be adjusted from 0.7 to 1.2 grams/denier dependent on molecular weight and/or spinning conditions.

The denier of the fiber may be produced from 5-2000 based on the desired fabric construction. A spandex yarn of denier 5-30 denier may have a filament count of between 1 and 5, and a yarn of denier 30-2000 may have a filament count from 20 to 200. The fiber may be used in fabrics of any sort (wovens, warp knits, or weft knits) in a content from 0.5% to 100% depending on the desired end use of the fabric.

The spandex yarn may be used alone or it may be plied, twisted, co-inserted, or mingled with any other yarn such as those suitable for apparel end uses, as recognized by the FTC (Federal Trade Commission). This includes, but is not limited to, fibers made from nylon, polyester, multi-component polyester or nylon, cotton, wool, jute, sisal, help, flax, bamboo, polypropylene, polyethylene, polyfluorocarbons, rayon, cellulosics of any kind, and acrylic fibers.

The spandex fiber may have a lubricant or finish applied to it during the manufacturing process to improve downstream processing of the fiber. The finish may be applied in a quantity of 0.5 to 10% by weight.

The spandex fiber may contain additives to adjust the initial color of the spandex or to prevent or mask the effects of yellowing after exposure to elements that can initiate polymer degradation such as chlorine, fumes, UV, NOx, or burnt gas. A spandex fiber may be made to have a "CIE" whiteness in the range of 40 to 160.

Polyurethaneurea and Polyurethane Compositions

Polyurethaneurea compositions useful for preparing fiber or long chain synthetic polymers that include at least 85% by weight of a segmented polyurethane. Typically, these include a polymeric glycol or polyol which is reacted with a diisocyanate to form an NCO-terminated prepolymer (a "capped glycol"), which is then dissolved in a suitable solvent, such as dimethylacetamide, dimethylformamide, or N-methylpyrrolidone, and then reacted with a difunctional chain extender. Polyurethanes are formed when the chain extenders are diols (and may be prepared without solvent). Polyurethaneureas, a sub-class of polyurethanes, are formed when the chain extenders are diamines. In the preparation of a polyurethaneurea polymer which can be spun into spandex, the glycols are extended by sequential reaction of the hydroxy end groups with diisocyanates and one or more diamines. In each case, the glycols must undergo chain extension to provide a polymer with the necessary properties, including viscosity. If desired, dibutyltin dilaurate, stannous octoate, mineral acids, tertiary amines such as triethylamine, N,N'-dimethylpiperazine, and the like, and other known catalysts can be used to assist in the capping step.

Suitable polyol components include polyether glycols, polycarbonate glycols, and polyester glycols of number average molecular weight of about 600 to about 3,500. Mixtures of two or more polyols or copolymers can be included.

Examples of polyether polyols that can be used include those glycols with two or more hydroxy groups, from ring-opening polymerization and/or copolymerization of ethylene oxide, propylene oxide, trimethylene oxide, tetrahydrofuran, and 3-methyltetrahydrofuran, or from condensation polymerization of a polyhydric alcohol, such as a diol or diol mixtures, with less than 12 carbon atoms in each molecule, such as ethylene glycol, 1,3-propanediol, 1,4-butanediol, 1,5-pentanediol 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polyether polyol is preferred, and a poly(tetramethylene ether) glycol of molecular weight of about 1,700 to about 2,100, such as Terathane® 1800 (INVISTA of Wichita, Kans.) with a functionality of 2, is one example of a specific suitable polyol. Co-polymers can include poly(tetramethylene-co-ethyleneether) glycol.

Examples of polyester polyols that can be used include those ester glycols with two or more hydroxy groups, produced by condensation polymerization of aliphatic polycarboxylic acids and polyols, or their mixtures, of low molecular weights with no more than 12 carbon atoms in each molecule. Examples of suitable polycarboxylic acids are malonic acid, succinic acid, glutaric acid, adipic acid, pimelic acid, suberic acid, azelaic acid, sebacic acid, undecanedicarboxylic acid, and dodecanedicarboxylic acid. Examples of suitable polyols for preparing the polyester polyols are ethylene glycol, 1,3-propanediol, 1,4-butanediol, 1,5-pentanediol 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear bifunctional polyester polyol with a melting temperature of about 5° C. to about 50° C. is an example of a specific polyester polyol.

Examples of polycarbonate polyols that can be used include those carbonate glycols with two or more hydroxy groups, produced by condensation polymerization of phosgene, chloroformic acid ester, dialkyl carbonate or diallyl carbonate and aliphatic polyols, or their mixtures, of low molecular weights with no more than 12 carbon atoms in each molecule. Examples of suitable polyols for preparing the polycarbonate polyols are diethylene glycol, 1,3-propanediol, 1,4-butanediol, 1,5-pentanediol, 1,6-hexanediol, neopentyl glycol, 3-methyl-1,5-pentanediol, 1,7-heptanediol, 1,8-octanediol, 1,9-nonanediol, 1,10-decanediol and 1,12-dodecanediol. A linear, bifunctional polycarbonate polyol with a melting temperature of about 5° C. to about 50° C. is an example of a specific polycarbonate polyol.

The diisocyanate component can also include a single diisocyanate or a mixture of different diisocyanate including an isomer mixture of diphenylmethane diisocyanate (MDI) containing 4,4'-methylene bis(phenyl isocyanate) and 2,4'-methylene bis(phenyl isocyanate). Any suitable aromatic or aliphatic diisocyanate can be included. Examples of diisocyanates that can be used include, but are not limited to, 1-isocyanato-4-[(4-isocyanatophenyl)methyl]benzene, 1-isocyanato-2-[(4-cyanatophenyl)methyl]benzene, bis(4-isocyanatocyclohexyl)methane, 5-isocyanato-1-(isocyanatomethyl)-1,3,3-trimethylcyclohexane, 1,3-diisocyanato-4-methyl-benzene, 2,2'-toluenediisocyanate, 2,4'-toluenediisocyanate, and mixtures thereof. Examples of specific polyisocyanate components include Mondur® ML (Bayer), Lupranate® MI (BASF), and Isonate® 50 O,P' (Dow Chemical), and combinations thereof.

A chain extender may be either water or a diamine chain extender for a polyurethaneurea. Combinations of different chain extenders may be included depending on the desired properties of the polyurethaneurea and the resulting fiber. Examples of suitable diamine chain extenders include: hydrazine; 1,2-ethylenediamine; 1,4-butanediamine; 1,2-butanediamine; 1,3-butanediamine; 1,3-diamino-2,2-dimethylbutane; 1,6-hexamethylenediamine; 1,12-dodecanediamine; 1,2-propanediamine; 1,3-propanediamine; 2-methyl-1,5-pentanediamine; 1-amino-3,3,5-trimethyl-5-aminomethylcyclohexane; 2,4-diamino-1-methylcyclohexane; N-methylamino-bis(3-propylamine); 1,2-cyclohexanediamine; 1,4-cyclohexanediamine; 4,4'-methylene-bis(cyclohexylamine); isophorone diamine; 2,2-dimethyl-1,3-propanediamine; meta-tetramethylxylenediamine; 1,3-diamino-4-methylcyclohexane; 1,3-cyclohexane-diamine; 1,1-methylene-bis(4,4'-diaminohexane); 3-aminomethyl-3,5,5-trimethylcyclohexane; 1,3-pentanediamine (1,3-diaminopentane); m-xylylene diamine; and Jeffamine® (Texaco).

When a polyurethane is desired, the chain extender is a diol. Examples of such diols that may be used include, but are not limited to, ethylene glycol, 1,3-propanediol, 1,2-propylene glycol, 3-methyl-1,5-pentanediol, 2,2-dimethyl-1,3-trimethylene diol, 2,2,4-trimethyl-1,5-pentanediol, 2-methyl-2-ethyl-1,3-propanediol, 1,4-bis(hydroxyethoxy) benzene, and 1,4-butanediol and mixtures thereof.

A blocking agent which is a monofunctional alcohol or a monofunctional dialkylamine may optionally be included to control the molecular weight of the polymer. Blends of one or more monofunctional alcohols with one or more dialkylamine may also be included.

Examples of monofunctional alcohols useful with the present invention include at least one member selected from the group consisting of aliphatic and cycloaliphatic primary and secondary alcohols with 1 to 18 carbons, phenol, substituted phenols, ethoxylated alkyl phenols and ethoxylated fatty alcohols with molecular weight less than about 750, including molecular weight less than 500, hydroxyamines, hydroxymethyl and hydroxyethyl substituted tertiary amines, hydroxymethyl and hydroxyethyl substituted heterocyclic compounds, and combinations thereof, including furfuryl alcohol, tetrahydrofurfuryl alcohol, N-(2-hydroxyethyl)succinimide, 4-(2-hydroxyethyl)morpholine, methanol, ethanol, butanol, neopentyl alcohol, hexanol, cyclohexanol, cyclohexanemethanol, benzyl alcohol, octanol, octadecanol, N,N-diethylhydroxylamine, 2-(diethylamino)ethanol, 2-dimethylaminoethanol, and 4-piperidineethanol, and combinations thereof.

Examples of suitable mono-functional dialkylamine blocking agents include: N,N-diethylamine, N-ethyl-N-propylamine, N,N-diisopropylamine, N-tert-butyl-N-methylamine, N-tert-butyl-N-benzylamine, N,N-dicyclohexylamine, N-ethyl-N-isopropylamine, N-tert-butyl-N-isopropylamine, N-isopropyl-N-cyclohexylamine, N-ethyl-N-cyclohexylamine, N,N-diethanolamine, and 2,2,6,6-tetramethylpiperidine.

Non-Polyurethaneurea Polymers

Other polymers that are useful with the multiple component and/or bicomponent fibers of the present invention include other polymers which are soluble or can be included in particulate form. The soluble polymers may be dissolved in the polyurethaneurea solution or coextruded with the solution spun polyurethaneurea composition. The result of co-extrusion can be a bicomponent or multiple component fiber having a side-by-side, concentric sheath-core, or eccentric sheath-core cross-section where one component is polyurethaneurea solution and the other component contains another polymer. Examples of other soluble polymers include polyurethanes (as described above), polyamides, acrylics, and polyaramides, among others.

Other polymers that are useful with the multiple component and/or bicomponent fibers of the present invention include other semicrystalline insoluble polymers included as a particulate form. Useful polyamides include nylon 6, nylon 6/6, nylon 10, nylon 12, nylon 6/10, and nylon 6/12. Useful polyolefins include polymers prepared from $C_2$ to $C_{20}$ monomers. This includes copolymers and terpolymers such as ethylene-propylene copolymers. Examples of useful polyolefin copolymers are disclosed in U.S. Pat. No. 6,867,260 to Datta et al., incorporated herein by reference.

Fiber Cross-Section Configurations

A variety of different cross-sections are useful with the invention of some embodiments. These include bicomponent or multiple component concentric or eccentric sheath-core and bicomponent or multiple component side-by-side. Examples of different cross-sections are shown in FIG. 1.

All fiber cross-sections shown in FIG. 1 have a compositionally different first region and second region. A 44 dtex/3 filament yarn is shown in FIGS. 1A and 1B, while a 44 dtex/4 filament yarn is shown in FIGS. 1C and 1D. The first region in each includes a pigment and the second region does not. FIGS. 1A and 1B include a 50/50 sheath-core cross-section; FIG. 1C includes a 17/83 sheath-core cross-section; and FIG. 1D includes a 50/50 side-by-side cross-section.

Each of the sheath-core and side-by-side cross-sections includes a boundary area between at least two compositionally different polyurethaneurea compositions. The boundary appears be a well-defined boundary in each of these figures, but the boundary may include a blended region. Where the boundary includes a blended region, the boundary itself is a distinct region which is a blend of the compositions of the first and second (or third, fourth, etc.) regions. This blend may be either a homogenous blend or may include a concentration gradient from the first region to the second region.

Additives

Classes of additives that may be optionally included in polyurethaneurea compositions are listed below. An exemplary and non-limiting list is included. However, additional additives are well-known in the art. Examples include: anti-oxidants, UV stabilizers, colorants, pigments, cross-linking agents, phase change materials (paraffin wax), antimicrobials, minerals (i.e., copper), microencapsulated additives (i.e., aloe vera, vitamin E gel, aloe vera, sea kelp, nicotine, caffeine, scents or aromas), nanoparticles (i.e., silica or carbon), nano-clay, calcium carbonate, talc, flame retardants, antitack additives, chlorine degradation resistant additives, vitamins, medicines, fragrances, electrically conductive additives, dyeability and/or dye-assist agents (such as quaternary ammonium salts). Other additives which may be added to the polyurethaneurea compositions include adhesion promoters, anti-static agents, anti-creep agents, optical brighteners, coalescing agents, electroconductive additives, luminescent additives, lubricants, organic and inorganic fillers, preservatives, texturizing agents, thermochromic additives, insect repellants, and wetting agents, stabilizers (hindered phenols, zinc oxide, hindered amine), slip agents (silicone oil) and combinations thereof.

The additive may provide one or more beneficial properties including: dyeability, hydrophobicity (i.e., polytetrafluoroethylene (PTFE)), hydrophilicity (i.e., cellulose), friction control, chlorine resistance, degradation resistance (i.e., antioxidants), adhesiveness and/or fusibility (i.e., adhesives and adhesion promoters), flame retardance, antimicrobial behavior (silver, copper, ammonium salt), barrier, electrical conductivity (carbon black), tensile properties, color, luminescence, recyclability, biodegradability, fragrance, tack control (i.e., metal stearates), tactile properties, settability, thermal regulation (i.e., phase change materials), nutriceutical, delustrant such as titanium dioxide, stabilizers such as hydrotalcite, a mixture of huntite and hydromagnesite, UV screeners, and combinations thereof.

Apparatus

Convenient references relating to fibers and filaments, including those of man-made bicomponent fibers, and incorporated herein by reference, are, for example:

a. Fundamentals of Fibre Formation—The Science of Fibre Spinning and Drawing, Adrezij Ziabicki, John Wiley and Sons, London/New York, 1976;
b. Bicomponent Fibres, R Jeffries, Merrow Publishing Co. Ltd, 1971;
c. Handbook of Fiber Science and Technology, T. F. Cooke, CRC Press, 1993;

Similar references include U.S. Pat. Nos. 5,162,074 and 5,256,050 incorporated herein by reference, which describes methods and equipment for bicomponent fiber production.

Extrusion of the polymer through a die to form a fiber is done with conventional equipment such as, for example, extruders, gear pumps and the like. It is preferred to employ separate gear pumps to supply the polymer solutions to the die. When blending additives for functionality, the polymer blend is preferably mixed in a static mixer, for example, upstream of the gear pump in order to obtain a more uniform dispersion of the components. Preparatory to extrusion each spandex solution can be separately heated by a jacketed vessel with controlled temperature and filtered to improve spinning yield.

In the illustrated embodiment of the invention, two different polymer solutions are introduced to a segmented, jacketed heat exchanger operating at 40-90 C. The extrusion dies and plates are arranged according to the desired fiber configuration and illustrated in FIG. 2 for sheath-core, FIG. 3 eccentric sheath-core, and FIG. 4 side-by-side. In all cases the component streams are combined just above the capillary. Pre-heated solutions are directed from supply ports (2) and (5) through a screen (7) to a distribution plate (4) and on to the spinneret (9) which is position by a shim (8) and supported with a nut (6).

Figure 2:
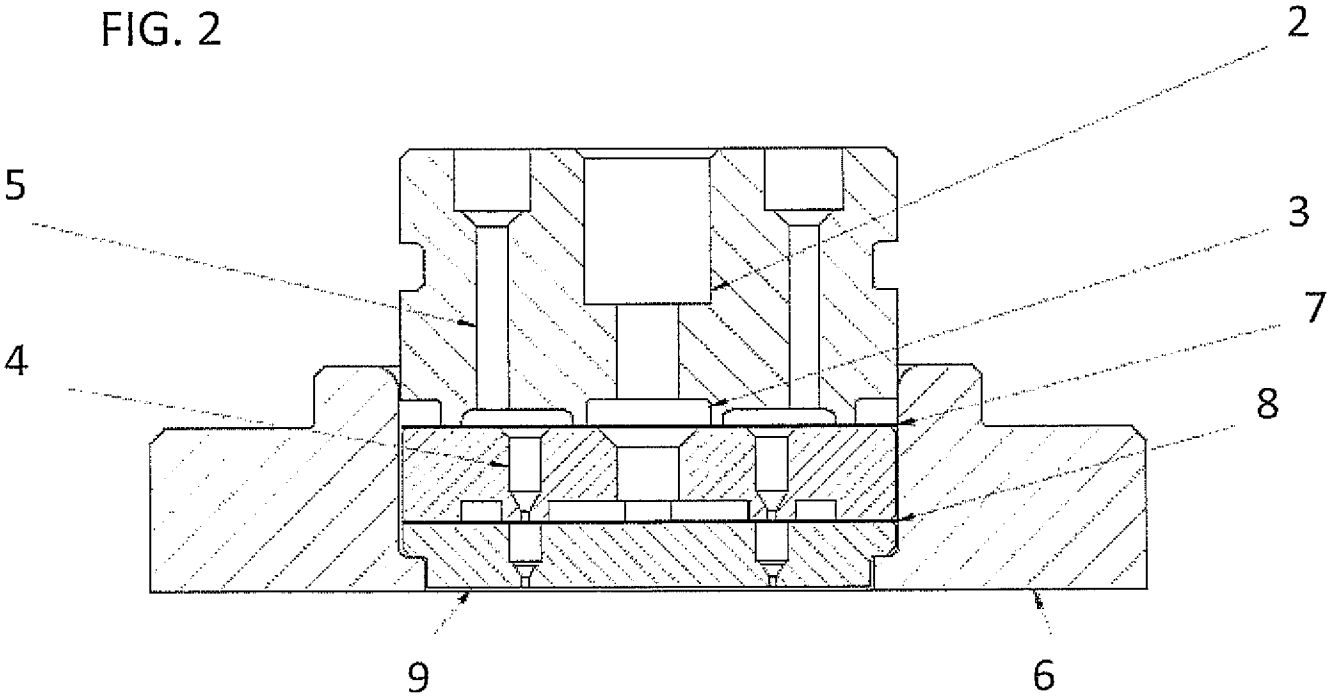
FIG. 2 is a schematic representation of a cross-section of a spinneret of some embodiments.
Figure 3:
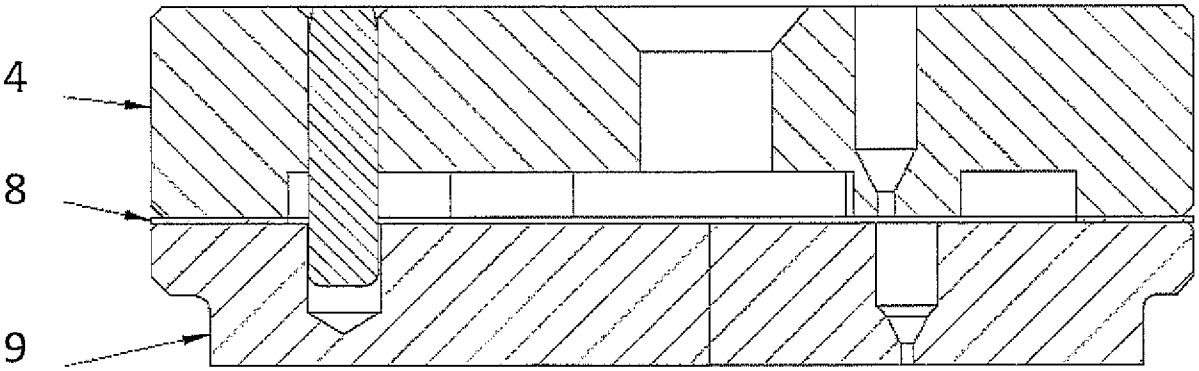
FIG. 3 is a schematic representation of a cross-section of a spinneret of some embodiments.
Figure 4:
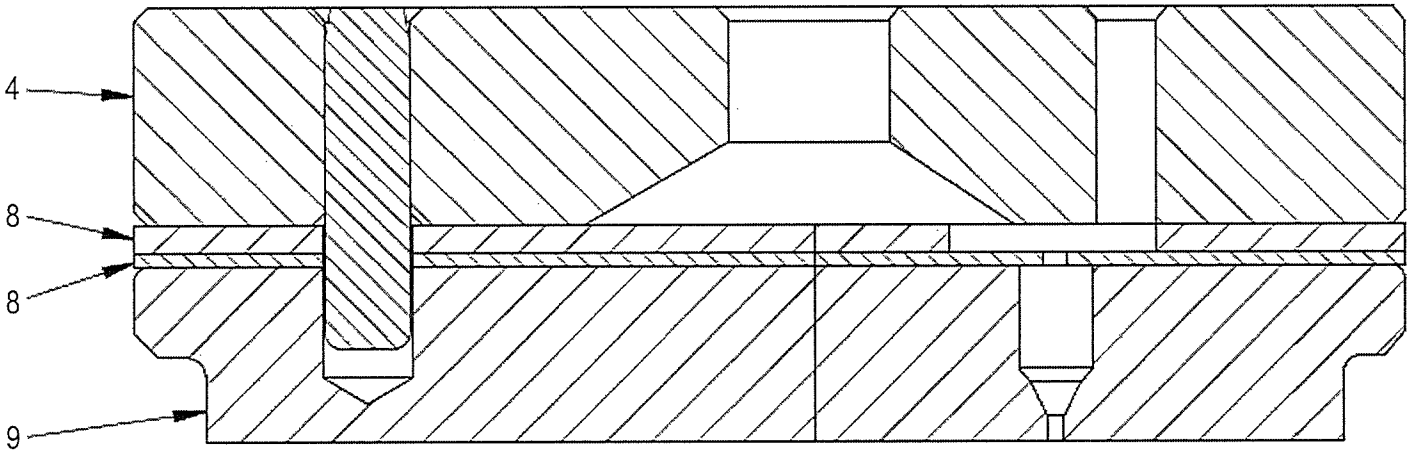
FIG. 4 is a schematic representation of a cross-section of a spinneret of some embodiments.

The extrusion dies and plates described in FIGS. 2, 3, and 4 are used with a conventional spandex spin cell such as that shown in U.S. Pat. No. 6,248,273, incorporated herein by reference.

The bicomponent spandex fibers may also be prepared by separate capillaries to form separate filaments which are subsequently coalesced to form a single fiber.

Process of Making Fibers

The fiber of some embodiments is produced by solution spinning (either wet-spinning or dry spinning) of the polyurethane-urea polymer from a solution with conventional urethane polymer solvents (e.g., DMAc). The polyurethaneurea polymer solutions may include any of the compositions or additives described above. The polymer is prepared by reacting an organic diisocyanate with appropriate glycol, at a mole ratio of diisocyanate to glycol in the range of 1.6 to 2.3, preferably 1.8 to 2.0, to produce a "capped glycol".

The capped glycol is then reacted with a mixture of diamine chain extenders. In the resultant polymer, the soft segments are the polyether/urethane parts of the polymer chain. These soft segments exhibit melting temperatures of lower than 60° C. The hard segments are the polyurethane/urea parts of the polymer chains; these have melting temperatures of higher than 200° C. The hard segments amount to 5.5 to 9%, preferably 6 to 7.5%, of the total weight of the polymer.

In one embodiment of preparing fibers, the polymer solutions containing 30-40% polymer solids are metered through desired arrangement of distribution plates and orifices to form filaments. Distribution plates are arranged to combine polymer streams in a one of concentric sheath-core, eccentric sheath-core, and side-by-side arrangement followed by extrusion thru a common capillary. Extruded filaments are dried by introduction of hot, inert gas at 300° C.-400° C. and a gas:polymer mass ratio of at least 10:1 and drawn at a speed of at least 400 meters per minute (preferably at least 600 m/min) and then wound up at a speed of at least 500 meters per minute (preferably at least 750 m/min). All examples given below were made with 80° C. extrusion temperature in to a hot inert gas atmosphere at a take-up speed of 762 IT/min. Standard process conditions are well-known in the art.

Yarns formed from elastic fibers made in accordance with the present invention generally have a tenacity at break of at least 0.6 cN/dtex, a break elongation of at least 400%, an unload modulus at 300% elongation of at least 27 mg/dtex.

Strength and elastic properties of the spandex were measured in accordance with the general method of ASTM D 2731-72. For the examples reported in Tables below, spandex filaments having a 5 cm gauge length were cycled between 0% and 300% elongation at a constant elongation rate of 50 cm per minute. Modulus was determined as the force at 100% (M100) and 200% (M200) elongation on the first cycle and is reported in grams. Unload modulus (U200) was determined at 200% elongation on the fifth cycle and is reported in the Tables in grams. Percent elongation at break and force at break was measured on the sixth extension cycle.

Percent set was determined as the elongation remaining between the fifth and sixth cycles as indicated by the point at which the fifth unload curve returned to substantially zero stress. Percent set was measured 30 seconds after the samples had been subjected to five 0-300% elongation/relaxation cycles. The percent set was then calculated as % Set=100(Lf−Lo)/Lo, where Lo and Lf are the filament (yam) length, when held straight without tension, before (Lo) and after (Lf) the five elongation/relaxation cycles.

The features and advantages of the present invention are more fully shown by the following examples which are provided for purposes of illustration, and are not to be construed as limiting the invention in any way.

EXAMPLES

Example 1—Stress-Strain Modification

A low modulus, high elongation polymer type A (a co-polyether-based spandex) was spun as the core polymer with polymer type B (a conventional poly-tetramethylene-ether based spandex) as the sheath at varying ratios to make a 44/4 product (44 decitex/4 filament). Tensile property analysis shows a surprising improvement with higher than expected (i.e. by linear addition) elongation/tenacity and lower modulus (M200) with 25% and 50% of the co-polyether based polymer type A. The ability to combine and tailor stress-strain properties enhances fiber suitability in broader applications from a narrow selection of polymer base materials.

TABLE 1

STRESS-STRAIN RESPONSE OF POLYMER B/POLYMER A - SHEATH/CORE FIBER

| 44/4 yarn | A | B | C | D | E |
|---|---|---|---|---|---|
| Polymer A - core | 0 | 25% | 50% | 75% | 100% |
| Polymer B - sheath | 100% | 75% | 50% | 25% | 0 |
| % Elongation | 491 | 542 | 566 | 578 | 601 |
| Breaking force (g) | 40.1 | 49.7 | 46.8 | 40.1 | 35.0 |
| M100 | 3.4 | 2.84 | 2.65 | 2.31 | 2.38 |
| M200 | 7.14 | 6.06 | 5.55 | 4.83 | 4.76 |
| Linear Addition | | | | | |
| % Elongation | 491 | 519 | 546 | 573 | 601 |
| Breaking force (g) | 40.1 | 38.8 | 37.6 | 36.3 | 35.0 |
| M100 | 3.4 | 3.12 | 2.89 | 2.6 | 2.4 |
| M200 | 7.1 | 6.5 | 5.95 | 5.4 | 4.8 |

Example 2—Fusible Sheath

A hot-melt crystalline thermoplastic polyurethane adhesive (Pearlbond 122 from Merquinsa Mercados Quimicos) was prepared as a 50/50 blend with conventional polytetramethyleneether-based spandex as 35% solution in DMAC and spun as the sheath with conventional spandex core to make a 44 decitex/3 filament yarn. Overall sheath content was 20% based on fiber weight to make a bondable yarn when heated above 80° C.

Yarn fusibility was measured by mounting a 15 cm long sample on an adjustable frame in triangle shape with the vertex centered at the frame and two equal side lengths of 7.5 cm. A second filament of the same length is mounted on the frame from the opposite side such that the two yarns intersect and crossover with a single contact point. Fibers are relaxed to 5 cm, then exposed to scouring bath for one hour, rinsed, air-dried, and subsequently exposed to a dye bath for 30 minutes, rinsed, and air-dried. The frame with fibers is adjusted from 5 cm to 30 cm in length, and exposed to steam at 121° C. for 30 seconds, cooled for 3 minutes, and relaxed. Yarns are removed from the frame and transferred to tensile testing machine with each yarn clamped by one end leaving the contact point positioned between the clamps. Yarns are extended at 100%/min and the force to break the contact point is recorded as the fusing strength.

Advantage is a yarn with excellent fusing characteristics combined with high stretch/recovery performance. Example yarns can be covered with polyamide or polyester yarns and fabrics constructed on circular and warp knitting machine. The covered yarn knit in an every course, tricot construction allows fusing of the elastic yarn at each contact point of the knitted structure. Adequate fusing may also be achieved where the fusible yarn is included in alternate courses.

TABLE 2

Property results for conventional spandex with adhesive blended sheath

| | Ex. 2 |
|---|---|
| % Sheath (w/w) | 20% |
| % Adhesive (w/w) | 10% |
| Elongation % | 452 |
| Breaking force (g) | 39.8 |

TABLE 2-continued

| Property results for conventional spandex with adhesive blended sheath | |
|---|---|
| | Ex. 2 |
| M200 (g) | 7.20 |
| U200 (g) | 0.93 |
| % SET | 43 |
| Fusing strength (g) | 10.2 |

Example 3—Thermal Regulating Spandex

Polyethylene glycol (PEG MW=600 from Sigma Aldrich, Latent heat=146 J/g, Tm=16 C) was mixed as a 50/50 blend with conventional spandex polymer in a 35% DMAC solution and spun as the core section with a conventional spandex sheath to make a 44 decitex/3 filament yarn. Final additive content was 16.5% by weight of the fiber. Table 3 shows the fiber's thermal response as measured with TA instruments model 2010 and gives 10.7 Jig latent heat associated with the PEG additive in the 15-25 C temperature range. A comparison to the theoretical maximum latent heat based on PEG content yields 44% efficiency in the polyurethane urea matrix.

Figure 5:
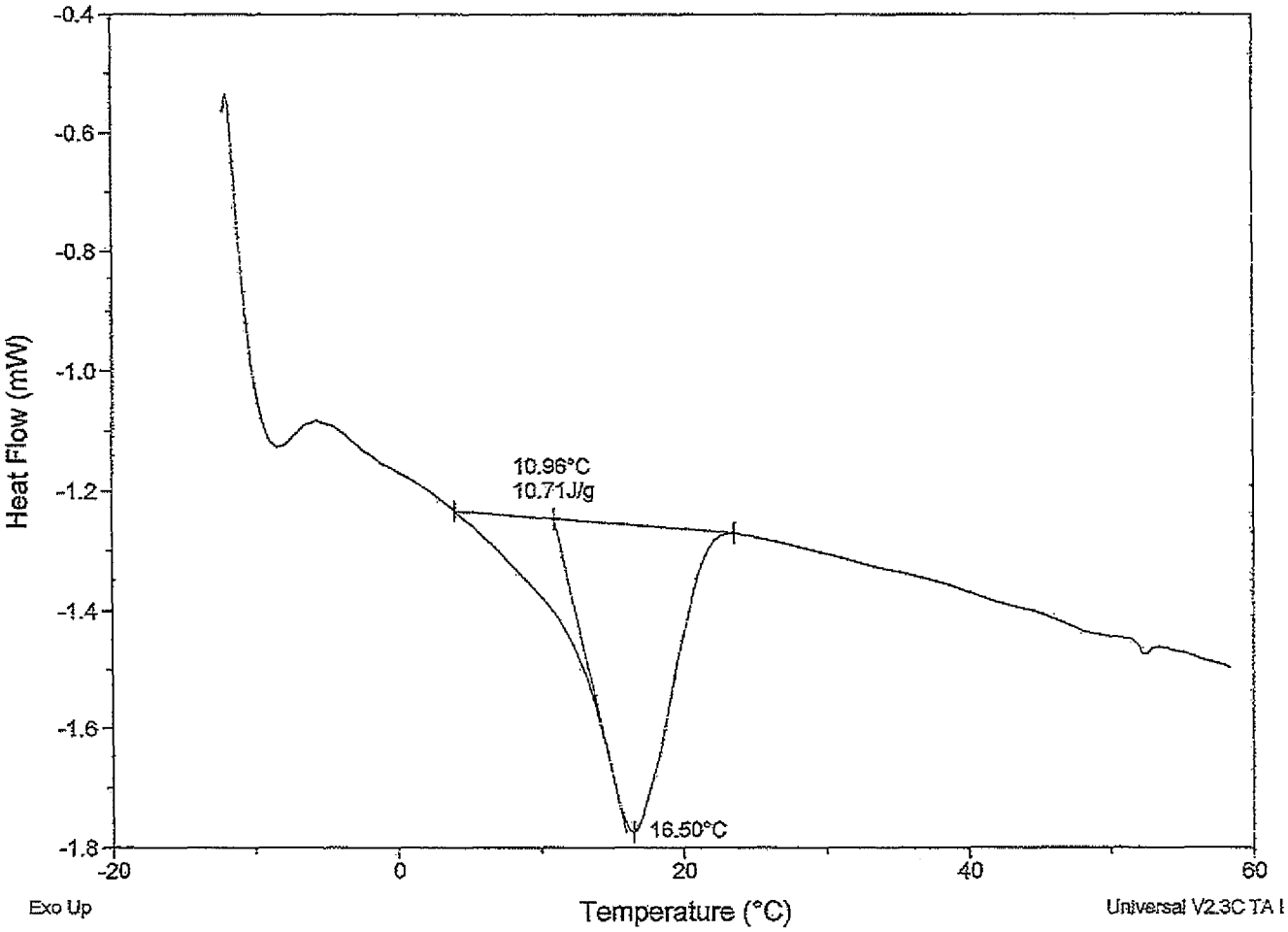
FIG. 5 is a depiction of the differential scanning calorimeter results for a fiber of one embodiment.

FIG. 5 shows Differential scanning calorimeter results for Ex. 3 spandex fiber. The test was conducted at 5 C/min rise rate.

Example yarns can be covered with polyamide or polyester yarns or combined with natural fibers such as cotton to provide a thermally-active elastic yarn. Such yarns can be formed into fabrics by weaving or knitting to yield comfortable foundation apparel with enhanced thermal regulating characteristics.

TABLE 3

| Tensile properties and heat capacity for spandex fiber | |
|---|---|
| | Ex. 3 |
| Core (w/w) | 33% |
| PEG (w/w) | 16.5% |
| % Elongation | 448% |
| Breaking force (g) | 31.1 |
| M200(g) | 5.52 |
| U200(g) | 1.14 |
| % Set | 22% |
| $\Delta H_{Theo}$ (J/g) | 24.1 |
| $\Delta H_{Meas}$ (J/g) | 10.7 |
| Efficiency | 44% |

Example 4—Conductive Spandex

Conductive carbon black (Conductex® 7055 Ultra® from Columbian Chemical Company) was dissolved as a 40/60 blend with conventional spandex polymer as a 35% solution in DMAC and spun as the core section with conventional spandex sheath (1:1 ratio) to produce a 44 decitex/3 filament yarn. Final carbon black content was 20% in yarn. Yarn skeins were mounted with silver-laden epoxy and electrical resistance was measured with a Fluke multimeter. Table 3 summarizes results and demonstrates $10^4$ decrease in resistance at rest (1×) and at 2× extension.

TABLE 4

| Resistance properties | | |
|---|---|---|
| Part | Standard | Ex. 4 |
| Core(w/w) | 0% | 50% |
| Carbon Black(w/w) | 0 | 20% |
| Ω/cm (1X) | $>10^{10}$ | $1.3 \times 10^6$ |
| Ω/cm (2X) | $>10^{10}$ | $2 \times 10^6$ |

The inventive yarns can be useful for wearable electronics and serve as a communication platform with applications in sportswear, healthcare, military and work wear. The conductive spandex provides stretch, recovery, drape and handle to fabrics and retains conventional textile behavior without stiff and rigid metal electrodes. Example yarns with conducting polymers can be integrated into traditional knit, woven, and non-woven structures.

While there have been described what are presently believed to be the preferred embodiments of the invention, those skilled in the art will realize that changes and modifications may be made thereto without departing from the spirit of the invention, and it is intended to include all such changes and modifications as fall within the true scope of the invention.

What is claimed is:

1. An elastic multiple component fiber comprising a cross-section, wherein at least a first region of said cross-section comprises a polyurethaneurea composition; and comprising a second region and a third region comprising a boundary region between said first region and said second region that includes a blend of said first region and said second region.

2. The fiber of claim 1 wherein the multiple components of the fiber are extruded through the same capillary into a single filament.

3. The fiber of claim 1 wherein the multiple components of the fiber are extruded through separate capillaries into separate filaments and coalesced into a single fused fiber.

4. The fiber of claim 1, wherein said first region and said second region have well-defined boundaries.

5. The fiber of claim 1, wherein said fiber is solution-spun.

6. The fiber of claim 1, wherein said cross-section includes a configuration selected from the group consisting of concentric sheath-core, eccentric sheath-core, side-by-side, and fused strands.

7. The fiber of claim 1 wherein said cross-section is non-round.

8. The fiber of claim 1, wherein said second region comprises a polyurethaneurea composition.

9. The fiber of claim 1, wherein said second region comprises a non-polyurethaneurea composition.

10. The fiber of claim 9, wherein said non-polyurethaneurea is prepared from one of a thermoplastic polymer and a soluble polymer.

11. The fiber of claim 1, wherein said first region and said second region include at least one different additive or the same additive at different concentrations.

12. The fiber of claim 1, wherein said first region and said second region each include a compositionally different polyurethaneurea.

13. The fiber of claim 1, wherein said first region and said second region each include different compositions.

14. The fiber of claim 1, wherein at least one region includes a composition that provides enhanced functionality or properties for textile fibers.

15. The fiber of claim 14, wherein said enhanced functionality includes at least one property selected from the group consisting of dyeability, hydrophobicity, hydrophilicity, friction control, chlorine resistance, degradation resistance, adhesiveness, fusibility, flame retardance, antimicrobial behavior, barrier, electrical conductivity, tensile properties, color, luminescence, recyclability, fragrance, tack control, tactile properties, set-ability, thermal regulation, nutriceutical, and combinations thereof.

16. The fiber of claim 1, wherein said at least one region includes additives selected from the group consisting of dye, pigment, polyolefin, nano-clay, chitosan, nylon, polyester, cellulose, polytetrafluoroethylene (PTFE), phase change materials, and combinations thereof.

17. An elastic multiple component solution-spun fiber comprising a cross-section, wherein at least a first region of said cross-section comprises a polyurethane or polyurethaneurea composition; and including a second region and a third region comprising a boundary region between said first region and said second region that includes a blend of said first region and said second region.

18. The fiber of claim 17, wherein said polyurethane or polyurethaneurea comprises a segmented polyurethane.

19. The fiber of claim 17, wherein the multiple components of the fiber are extruded through the same capillary into a single filament.

20. The fiber of claim 17, wherein the multiple components of the fiber are extruded through separate capillaries into separate filaments and coalesced into a single fused fiber.

21. The fiber of claim 17, wherein said first region and said second region have well-defined boundaries.

22. The fiber of claim 17, wherein said cross-section includes a configuration selected from the group consisting of concentric sheath-core, eccentric sheath-core, side-by-side and fused strands.

23. The fiber of claim 17, wherein said cross-section is non-round.

24. The fiber of claim 17, wherein said second region comprises a polyurethaneurea composition.

25. The fiber of claim 17, wherein said first region and said second region include at least one different additive or the same additive at different concentrations.

26. The fiber of claim 17, wherein said first region and said second region each include a compositionally different polyurethaneurea.

27. The fiber of claim 17, wherein said first region and said second region each include different compositions.

28. The fiber of claim 17, wherein said second region comprises a non-polyurethaneurea composition selected from a thermoplastic polymer and a soluble polymer.

29. The fiber of claim 17, wherein at least one region includes a composition that provides enhanced functionality for textile fibers.

30. The fiber of claim 29, wherein said enhanced functionality includes at least one property selected from the group consisting of dyeability, hydrophobicity, friction control, chlorine resistance, degradation resistance, adhesiveness, fusibility, flame retardance, antimicrobial behavior, barrier, electrical conductivity, tensile properties, color, recyclability, fragrance, tack control, tactile properties, and combinations thereof.

31. An article comprising the elastic multiple component fiber of claim 17.

32. The article of claim 31, wherein said article is a fabric.

33. The article of claim 31, wherein said fabric is selected from woven, nonwoven, and knit.

34. The article of claim 31, wherein said cross-section includes a configuration selected from the group consisting of concentric sheath-core, eccentric sheath-core, side-by-side and fused strands.

35. The article of claim 31, wherein said cross-section provides at least a first region and a second region which comprise compositionally different polyurethaneurea compositions.

36. The article of claim 31, wherein at least one region includes at least one additive that provide at least one property selected from the group consisting of dyeable, hydrophobic, friction reduction, chlorine resistance, adhesive, fusible, flame retardant, antimicrobial, barrier, conductive, and combinations thereof.

37. The article of claim 31, wherein said article is a textile.

38. The article of claim 31, wherein said article is a garment.

39. The article of claim 31, wherein said article is hosiery.

* * * * *